United States Patent [19]

Benham

[11] 4,307,804

[45] Dec. 29, 1981

[54] SECURE PRODUCT-TO-CARD OR CARD TYPE PACKAGE HAVING PREAPPLIED HEAT SHRINKABLE PLASTIC FILM

[75] Inventor: Albert A. Benham, Granville, Mass.

[73] Assignee: Champion International Corporation, Stamford, Conn.

[21] Appl. No.: 127,586

[22] Filed: Mar. 6, 1980

[51] Int. Cl.[3] ..... B65D 65/00; B65D 71/08; B65D 75/00

[52] U.S. Cl. ..... 206/45.33; 206/497; 229/87 F; 229/87 H; 229/DIG. 12

[58] Field of Search ..... 206/45.33, 45.31, 497, 206/471; 229/DIG. 12, DIG. 7, 87 R, 87 H, 87 F

[56] References Cited

U.S. PATENT DOCUMENTS

| | | | |
|---|---|---|---|
| 2,290,359 | 7/1942 | Ringler | 229/87 H |
| 2,932,384 | 4/1960 | Johnnides | 206/45.33 |
| 3,334,734 | 8/1967 | Meyers | 206/45.31 |
| 3,493,107 | 2/1970 | Murkey | 206/45.33 |
| 4,036,362 | 7/1977 | Ullman | 206/497 |
| 4,087,003 | 5/1978 | Adannah | 206/583 |
| 4,174,037 | 11/1979 | Chow | 206/471 |
| 4,213,531 | 7/1980 | Rae | 206/45.33 |

FOREIGN PATENT DOCUMENTS

| | | | |
|---|---|---|---|
| 691904 | 8/1964 | Canada | 206/497 |

*Primary Examiner*—Herbert F. Ross
*Attorney, Agent, or Firm*—Evelyn M. Sommer

[57] ABSTRACT

A product-to card or card type package is provided having a preapplied heat shrinkable plastic film for securing a product thereto. More particularly, a package is provided having a main panel and a pair of side support panels which are hingedly connected to the opposed side edges of the main panel. A heat shrinkable film extends between the side support panels and is adhesively connected thereto such that after a product is inserted between the plastic film and the main panel, and thereafter the package is subjected to heat, the plastic film will shrink into close conformity with the product thereby causing the side support panels to be drawn into abutting relationship with the product such that the product is secured to the package. An aperture may be provided in the main panel for receiving a portion of the product so as to aid in preventing longitudinal shifting of the product in the package.

11 Claims, 9 Drawing Figures

SECURE PRODUCT-TO-CARD OR CARD TYPE PACKAGE HAVING PREAPPLIED HEAT SHRINKABLE PLASTIC FILM

BACKGROUND OF THE INVENTION

The subject invention relates to a package having a preapplied heat shrinkable plastic film for enclosing a product therein. More particularly, a package is provided which may be shipped from the carton manufacturer with a preapplied heat shrinkable plastic film adhesively connected thereto, such that the user merely has to insert the product therein and heat the package to fully seal and secure the product to the package.

The subject package includes a main panel and a pair of side support panels which are hingedly connected to the opposed side edges of the main panel. Heating of the package causes the plastic film to shrink which functions to draw the side support panels into abutting relationship with the product thereby securely enclosing the product or at least a portion thereof within the package.

Prior art packages have employed the use of heat shrinkable plastic film to securely hold products therewithin and in addition, to protect the product from the outside environment. A typical example of such prior art packaging is disclosed in U.S. Pat. No. 4,087,003, assigned to the same assignee as the subject invention, wherein a rectangular, tubular carton is provided with an interior heat shrinkable plastic casing which when heated, functions to surround and space an array of articles away from the side walls of the container.

Heat shrinkable plastics have also been employed in the prior art when the product is placed on a display card and a plastic film is subsequently wrapped therearound to secure the product to the card. In these prior art packages, the product manufacturer first purchases display cards from the package manufacturer, and thereafter places the product on the display card and mechanically draws a tubular sheet of plastic film around the entire package. The prior art package as thus formed is then subjected to heat, thereby enclosing the product therein. The process of drawing the plastic around the package is both time consuming and expensive, and in addition, requires the purchase of complicated machinery to carry out the drawing process. In addition, the entire product is enclosed within the shrink-wrap package therby preventing a potential consumer from handling the product prior to actual purchase thereof.

Accordingly, it is an object of the subject invention to provide a package having a preapplied heat shrinkable plastic material adhesively connected thereto such that the product manufacturer merely has to insert the product therein and subject the package to heat to secure or enclose the product to the card.

It is another object of the subject invention to provide a new and improved package which includes side support panels which are pivotally connected to a main panel and are drawn into abutting relationship with the product during the heating of the plastic film, to thereby securely hold the product to the package.

It is a further object of the subject invention to provide a new and improved package which can be utilized by the product manufacturer without the need for expensive plastic film drawing machinery.

It is still a further object of the subject invention to provide a new and improved card type package wherein a product is secured to a card, yet a portion of the product is exposed in order to enable a potential consumer to handle the product.

SUMMARY OF THE INVENTION

In accordance with these and many other objects, the subject invention provides for a package having a preapplied heat shrinkable plastic film for enclosing the product therein. More particularly, a new and improved package is provided having a main display panel and a pair of side support panels respectively hingedly connected to the opposed side edges of the panel. A heat shrinkable plastic film is provided which extends between the side support panels and is adhesively connected thereto. A product may be inserted in the package between the plastic film and the main display panel and thereafter subjected to heat, such that the plastic film will shrink into close conformity with the product. The shrinking of the plastic film functions to draw the side support panels into abutting relationship with the product to thereby seal and hold the product within the package. The main display panel may be provided with apertures or cut-outs corresponding to the configuration of the product or portions thereof whereby, after the package has been formed, the film forces at least a portion of the product through the cut-out thereby aiding in preventing shifting of the product. Still further, the package may be designed such that only a portion of the product is secured to the package thereby maintaining economy of the package and permitting a potential customer to handle the product.

Other objects and advantages of the subject invention will become apparent from the following detailed description when taken in conjunction with the accompanying drawings, in which:

DETAILED DESCRIPTION OF THE PREFERRED EMBODIMENTS

Figure 1:
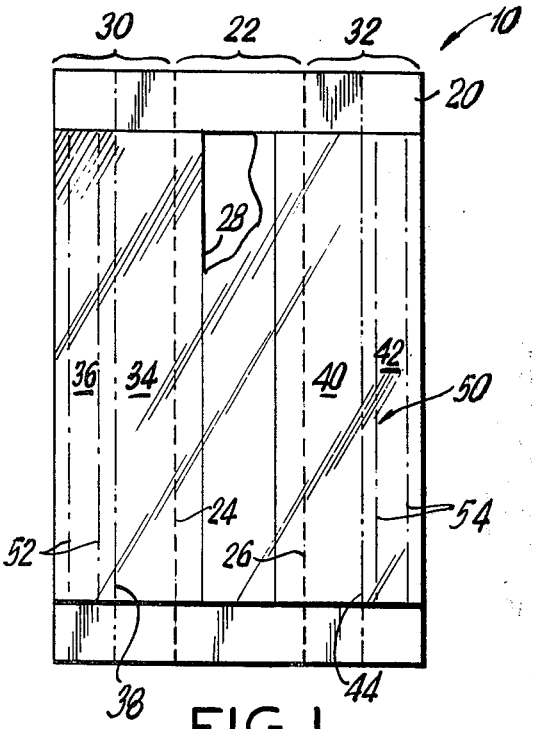
FIG. 1 is a top plan view of the package of the subject invention illustrating a preliminary stage in its formation.

Referring now more particularly to FIG. 1, the package of the subject invention is illustrated and is designated generally by the numeral 10. The package 10 is formed from a paperboard blank 20 having a generally rectangular configuration and is provided with a plurality of parallel, longitudinally extending hinge lines to define the panels of the package. More specifically, a main panel 22 is provided and is defined by longitudinally extending hinge lines 24 and 26 disposed on the opposed side edges thereof. An aperture or cut-out 28 may be provided in main panel 22. First and second side support panels 30 and 32 are provided and are hingedly connected to the main panel 22 along hinge lines 24 and 26.

In the first embodiment of the subject invention, the side support panels 30 and 32 are formed having two hingedly connected, longitudinally extending members. In particular, first side panel 30 includes an upper member 34 and a lower member 36 which are hingedly connected along fold line 38. Similarly, second side panel 32 includes upper member 40 and lower member 42 which are hingedly connected along fold line 44. As described more fully hereinafter, the upper and lower members are adhesively joined to form double layered, reinforced side support panels 30, 32. In the preferred embodiment the package 10 extends longer than the length of the product P, with the length of aperture 28 substantially corresponding to the length of the product P, but being of less width than the width of the product P, as more fully discussed hereinafter.

In accordance with the subject invention, a heat shrinkable plastic film 50 is provided which extends between and is adhesively connected to the opposed side support panels 30, 32. The heat shrinkable film 50 is bonded to the first side support panel 30 along the upper surface of lower member 36 in the area between phantom lines 52. Similarly, the opposed edge of the heat shrinkable plastic film 50 is bonded to second side support panel 32 along the upper surface of the lower member 42 between the phantom lines 54. In a preferred embodiment, the width of the plastic film 50, between the adhesive connections to the side support panels 30, 32 is substantially equal to the width of the paperboard 20 between the adhesive connections. In addition, the adhesive connections between the plastic film 50 and the side support panels 30, 32 are spaced from the hinged connection between the side support panels 30, 32 and the main panel 22. By this arrangement, and as discussed further hereinbelow, the drawing of the side support panels 30, 32 into abutting relationship with the product, resulting from the shrinking of the plastic film 50 can be achieved. It is noted that the length of the plastic film 50 substantially corresponds to the length of the product P and thus the length of the cut-out 28.

Figure 2:
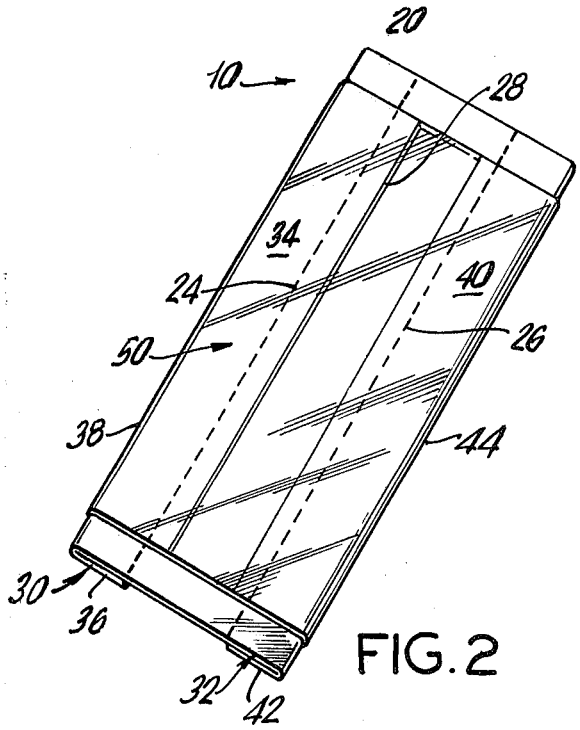
FIGS. 2 through 4 are perspective view of the package of the subject invention illustrating subsequent stages in the formation of the finished package.
Figure 3:
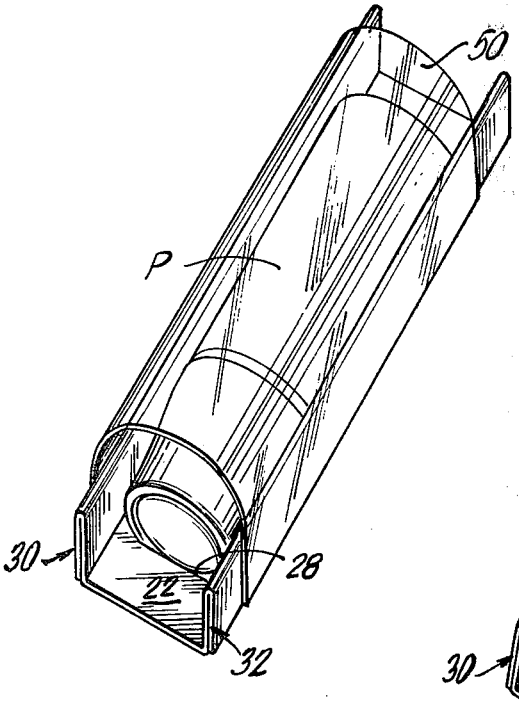

To complete the formation of the subject package, the lower members 36, 42 are pivoted into abutting relationship with the upper members 34, 40 of the side support panels 30, 32, as illustrated in FIG. 2, and are adhesively connected thereto. More particularly, the lower member 36 of first side panels 30 is pivoted about fold line 38 such that the lower surface thereof is contiguous with and may be adhesively connected to the lower surface of the upper member 34. Similarly, lower member 42 of second side panel 32 is pivoted about fold line 44 such that the lower surface thereof can be adhesively connected to the lower surface of upper member 40 to form the package as illustrated in FIG. 2. By this arrangement, each side support panel 30, 32 is double layered, such that the structural integrity of the package is increased. Further, the dual-wall panels serve to protect the product from the outside environment.

The package, as illustrated in FIG. 2, may be shipped to the product manufacturer in a flattened, non-erected configuration. The product manufacturer, upon receiving the finished package from the container manufacturer, merely has to mechanically or manually insert the product between the heat shrinkable plastic film 50 and the main panel 22 such that the product P is partially seated in the cut-out 28. Thereafter, the composite package is subjected to heat to form a secure package having a relatively high degree of structural rigidity. As illustrated in FIG. 3–6, the heat shrinkable film 50 is initially spaced away from the upper surface of main panel 22 to allow for the insertion of a product P therein. The initial raising or spacing of the heat shrinkable film 50 prior to the insertion of the product, causes the side support panels 30, 32 to pivot into an upright position. More particularly, since the width of the plastic film 50 between fold lines 38 and 44 is substantially equal to the width of the paperboard sheet 20, the spacing of the film 50 away from main panel 22, to allow for the insertion of the product P, produces a biasing force on the outer edges 38, 44 of the side support panels 30, 32 which causes them to pivot into an upright position. It is preferred that the side support panels 30 and 32 have a width such that when in the upright orientation, they extend to at least one-half the height or thickness of the product P to be container within the package. By this arrangement, the product may be securely held within the package 10, and in addition, the package 10 will be provided with increased structural rigidity.

Figure 4:
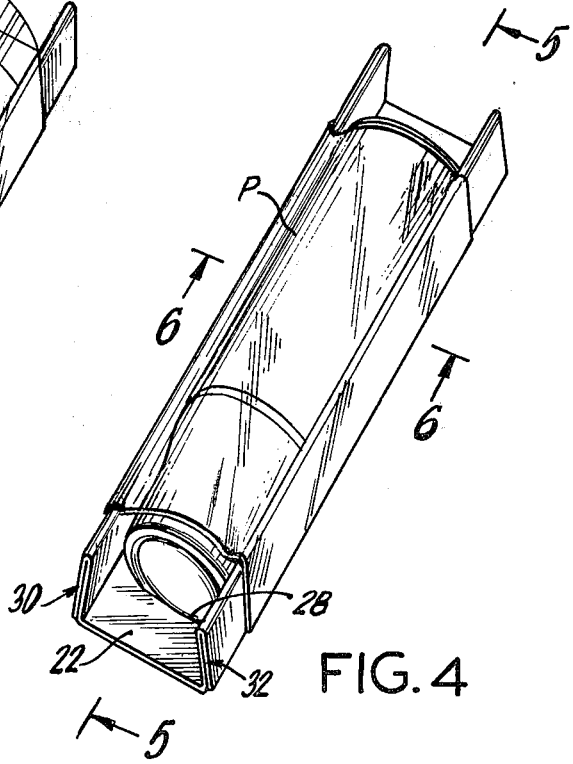
Figure 5:
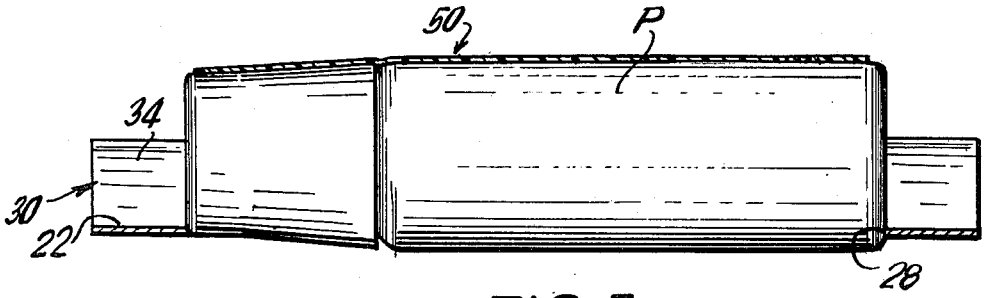
FIG. 5 is a cross-sectional view of the package of the subject invention, taken along the line 5—5 of FIG. 4.
Figure 6:
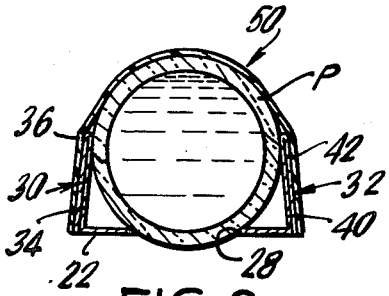
FIG. 6 is a cross-sectional view of the package of the subject invention, taken along the line 6—6 of FIG. 4.

To seal the package 10, the latter is heated by passing it through a conventional heat tunnel. Heating of the plastic film 50 causes it to shrink into close conformity with the product P, as illustrated in FIGS. 4–6. The shrinking of the plastic film 50 creates an inwardly directed biasing force on the edges 38 and 44 of the side support panels 30, 32 which draws the panels into an inclined position, in abutting relationship with the product P. As more particularly illustrated in FIG. 6, the side support panels 30, 32 which are held in place by the tension of the plastic film 50, function to maintain the position of the product P within the package 10. The interengagement of product P within the cut-out 28 also aids in preventing movement of the product P, and especially longitudinal shifting thereof relative to the package 10. The plastic film 50 additionally functions to protect the product P from being handled or otherwise contaminated from outside sources. More particularly, as illustrated in FIG. 5, preferably the opposed ends of the plastic film are respectively disposed adjacent the opposite ends of the product P for protecting same during handling by a potential consumer.

Figure 8:
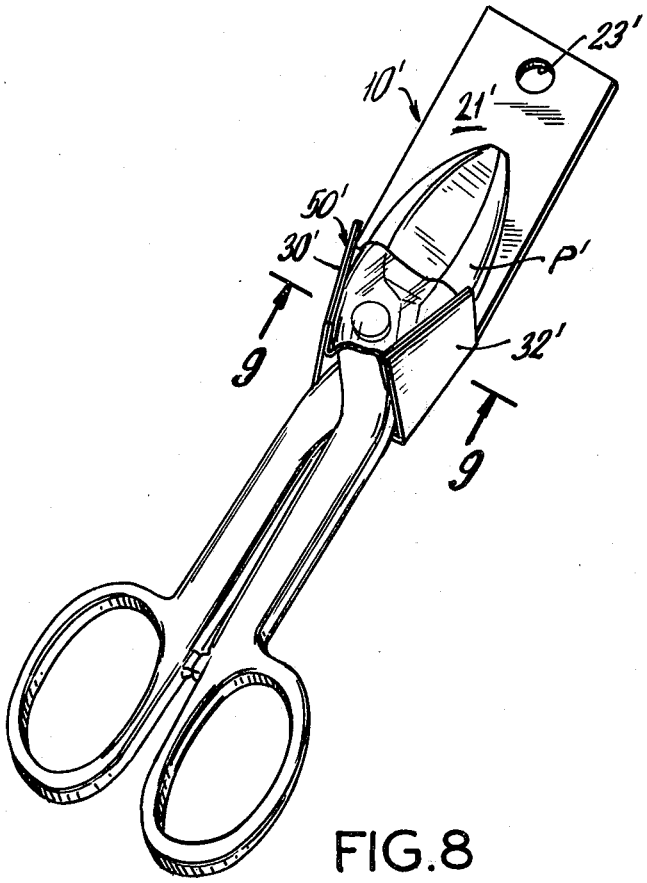
FIG. 8 is a perspective view of the second embodiment of the package of the subject invention illustrating a product secured thereto.
Figure 7:
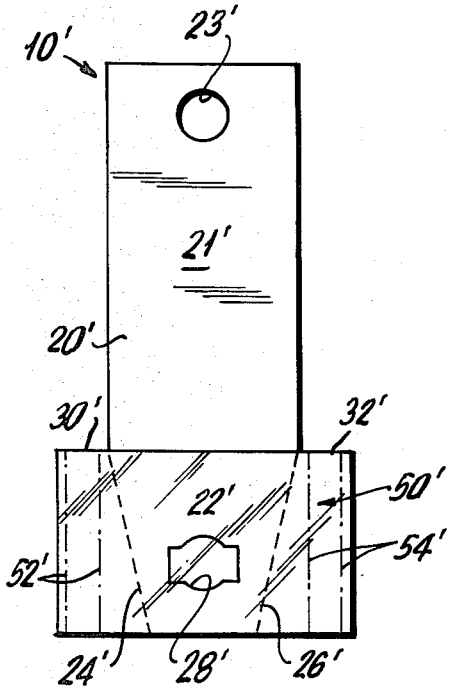
FIG. 7 is a top plan view of a second embodiment of the package of the subject invention.
Figure 9:
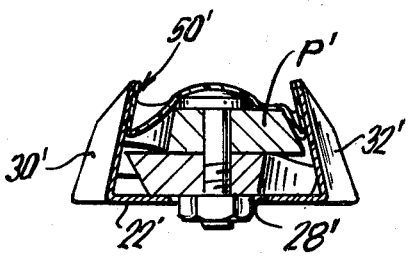
FIG. 9 is a cross-sectional view taken along line 9—9 in FIG. 8.

FIGS. 7–9 illustrate a second embodiment of the package 10′ of the subject invention, and more particularly, a package which is economical and which enables the potential customer to handle at least a portion of the product, in this case a pair of shears P′. Package 10′ includes a main panel formed from a paperboard sheet 20′ having a generally inverted T-shaped configuration. A display panel area 21′ is provided and is generally rectangular in configuration, and may be used to provide space for the printing of indicia. Display panel 21′ includes aperture 23′ for hanging the package 10′ for display. The lower portion of the paperboard sheet 20′ includes a generally V-shaped main panel 22′ which corresponds to the main panel 22 of the first embodiment, and which includes an aperture 28′ for accommodating the pivot pin of shears P′.

The package 10′ further includes first and second side support panels 30′ and 32′ of generally trapezoidal configuration. The side support panels 30′ and 32′ are hingedly connected to the main panel 22′ along angled fold lines 24′ and 26′. Heat shrinkable plastic film 50′ extends between and is adhesively connected to the opposed side support panels 30′ and 32′. More specifically, the shrinkable plastic film 50' is adhesively connected to the side panel 30' between the parallel phantom lines 52'. Similarly, the opposed edge of film 50' is adhesively connected to second side support panel 32' between parallel phantom lines 54'. The package 10' as thus formed, may be shipped to the product manufacturer for the insertion and sealing of the product therein.

As in the first embodiment, the plastic film 50' is raised and spaced from the upper surface of the main panel 22' such that a biasing force on the side support panels 30' and 32' causes them to pivot into a substantially upright position. The product P' may then be inserted between the lower surface of the plastic film 50' and the upper surface of the main sheet 22', with the projecting pivot pin of the product P' disposed within aperture 28'. The entire package is then heated by passing it through a conventional shrink tunnel which causes the plastic film 50' to shrink into close conformity with the product, as illustrated in FIGS. 8 and 9. More specifically, the film 50' shrinks into conformity with the product and into abutting relationship with the main panel 22' around the outer edges of the product. In addition, the shrinking of the plastic film 50' causes the side support panels 30', 32' to be drawn inwardly into abutting relationship with the product to thereby enclose, contain and securely support the cutting blade portion of shears P'.

Accordingly, there is provided a new and improved package having a preapplied heat shrinkable plastic film for securing a product thereto. The subject package includes a main panel and a pair of side support panels respectively hingedly connected to the opposed side edges of the main panel. In addition, a heat shrinkable film is provided which extends between the side support panels and is adhesively connected thereto such that when a product is inserted in the package between the plastic film and the main panel, and thereafter the package is subjected to heat, the plastic film will shrink into close conformity with the product thereby causing the side support panels to be drawn into abutting relationship with the product such that the product is securely held in the package. Suitable apertures may be provided in the main panel for partially engaging the product so as to aid in preventing longitudinal movement of the product relative to the package.

Although the subject package has been described by reference to preferred embodiments, it is apparent that other modifications could be devised by those skilled in the art that would fall within the scope and spirit of the present invention as defined by the appended claims.

What is claimed is:

1. A composite blank for forming a package having a preapplied heat shrinkable plastic film for securing a product thereto comprising:

a sheet having first and second sides defining a main panel and a pair of side support panels hingedly connected by means of fold lines to the opposed edges of said main panel; and a heat shrinkable plastic film substantially coextensive with said sheet and extending between said side support panels on a first side of said sheet and adhesively connected thereto on said first side, whereby when a product is inserted in said blank between said plastic film and said main panel portion of said first side of said sheet, and thereafter said blank is subjected to heat, said plastic film will shrink into close conformity with said product thereby causing said side support panels to be drawn inwardly into abutting relationship with said product by said shrinking plastic such that the product is secured to said main panel, said side panels and said shrinking plastic.

2. A blank as recited in claim 1 wherein the adhesive connection between said side support panels and said plastic film is spaced from the hinged connection between the main panel and the side support panels, thereby enabling said side support panels to be inwardly drawn when subjected to the biasing force resulting from the shrinking of the plastic film.

3. A blank as recited in claim 1 wherein said main panel includes an aperture through which a portion of said product projects for aiding in preventing shifting of said product relative to said main panel.

4. A blank as recited in claim 3 wherein the width of the plastic film between the adhesive connections to the opposed side support panels is substantially equal to the width of the paperboard material between said adhesive connections such that shrinking of the plastic film under heat will result in said side support panels being subjected to a biasing force thereby causing said side support panels to be inwardly drawn into abutting relationship with the product.

5. A blank as recited in claim 1 wherein said main panel and side support panels are generally rectangular in configuration.

6. A blank as recited in claim 1 wherein each said side support panel is formed of an upper member adhesively connected on the second side of said sheet to a portion of said sheet folded to become a lower member, said upper member, after folding, overlying and being contiguous with said lower member thereby forming dual layered, reinforced side support panels such that the structural integrity of the package is increased.

7. A blank as recited in claim 6 wherein said plastic film is adhesively connected to said lower members of said side support panels on the portion thereof which is said first side of said sheet.

8. A blank as recited in claim 1 wherein said main panel is generally V-shaped and said side support panels are generally trapezoidal in configuration, with the hinged connections between said side support panels and said main panel being angled.

9. A blank as recited in claim 8 further including a display panel integrally formed and extending from said main panel, said display panel for providing an area for the printing of indicia.

10. A blank as recited in claim 9 wherein said display panel further includes an aperture to enable the product to be hung for display.

11. A blank as recited in claim 8 wherein said main panel includes an aperture through which a portion of said product projects for aiding in preventing shifting of said product relative to said main panel.

* * * * *